US009259604B2

(12) United States Patent
Miller, Jr.

(10) Patent No.: US 9,259,604 B2
(45) Date of Patent: Feb. 16, 2016

(54) EXERCISE MACHINE FOR PERFORMING SQUATS

(71) Applicant: Elwood Bernard Miller, Jr., National City, CA (US)

(72) Inventor: Elwood Bernard Miller, Jr., National City, CA (US)

( * ) Notice: Subject to any disclaimer, the term of this patent is extended or adjusted under 35 U.S.C. 154(b) by 216 days.

(21) Appl. No.: 13/886,725

(22) Filed: May 3, 2013

(65) Prior Publication Data

US 2014/0066275 A1 Mar. 6, 2014

Related U.S. Application Data

(60) Provisional application No. 61/695,643, filed on Aug. 31, 2012.

(51) Int. Cl.

| | |
|---|---|
| ***A63B 26/00*** | (2006.01) |
| ***A63B 21/00*** | (2006.01) |
| ***A63B 21/068*** | (2006.01) |
| ***A63B 23/04*** | (2006.01) |
| *A63B 71/06* | (2006.01) |
| *A63B 71/02* | (2006.01) |

(52) U.S. Cl.

CPC ..... *A63B 21/00047* (2013.01); *A63B 21/068* (2013.01); *A63B 21/4033* (2013.01); *A63B 23/0405* (2013.01); *A63B 21/00181* (2013.01); *A63B 71/0622* (2013.01); *A63B 2023/0411* (2013.01); *A63B 2071/027* (2013.01); *A63B 2220/17* (2013.01); *A63B 2225/093* (2013.01)

(58) Field of Classification Search

CPC ..... A63B 23/0211; A63B 21/00047; A63B 21/1465; A63B 21/068; A63B 21/00181; A63B 23/0405; A63B 2071/027

USPC ..... 482/142

See application file for complete search history.

(56) References Cited

U.S. PATENT DOCUMENTS

| | | | | |
|---|---|---|---|---|
| 3,920,240 | A | 11/1975 | Ross | |
| 4,834,364 | A | 5/1989 | Gongwer et al. | |
| 4,925,185 | A | 5/1990 | Gongwer et al. | |
| 5,162,030 | A | 11/1992 | Tanski | |
| 5,685,810 | A * | 11/1997 | Chung | 482/112 |
| 5,700,232 | A * | 12/1997 | Clausen et al. | 482/125 |
| 5,820,520 | A | 10/1998 | Sieber | |
| 6,270,448 | B1 | 8/2001 | Smith | |
| 6,287,244 | B1 * | 9/2001 | Boos | 482/142 |
| 6,981,934 | B1 | 1/2006 | Shifferaw | |
| 7,556,592 | B2 | 7/2009 | Nizam | |
| 7,559,881 | B1 | 7/2009 | Roraff | |
| 7,569,003 | B1 | 8/2009 | Huffman | |
| D724,678 | S * | 3/2015 | Miller, Jr. | D21/691 |
| 2003/0224913 | A1 * | 12/2003 | Kuo | 482/142 |
| 2009/0305856 | A1 * | 12/2009 | Pandozy | 482/140 |
| 2011/0319237 | A1 * | 12/2011 | Jones et al. | 482/140 |

(Continued)

*Primary Examiner* — Oren Ginsberg
*Assistant Examiner* — Megan Anderson
(74) *Attorney, Agent, or Firm* — Greer, Burns & Crain, Ltd.

(57) ABSTRACT

An exercise machine is provided for a user performing squats. A base supports the exercise machine, and an upright member having a free end and an attachment end is mounted to the base at the attachment end and configured to be straddled by the user. A leg pad assembly is adjustably attached to the upright member for vertically adjusting a height of the leg pad assembly. The leg pad assembly has a first leg pad member extending horizontally relative to the upright member and configured to engage a back of the user's legs. A locking mechanism is provided for selectively releasably securing the leg pad assembly in a desired position on the upright member.

20 Claims, 5 Drawing Sheets

(56) References Cited

U.S. PATENT DOCUMENTS

2012/0225759 A1* 9/2012 Tsai ..... 482/131
2012/0295780 A1* 11/2012 Chou ..... 482/142
2013/0130875 A1* 5/2013 Chou ..... 482/139
2015/0011370 A1* 1/2015 Henniger ..... 482/145

* cited by examiner

EXERCISE MACHINE FOR PERFORMING SQUATS

CROSS-REFERENCE TO RELATED APPLICATION

This application claims the benefit of U.S. Provisional Application No. 61/695,643, filed Aug. 31, 2012.

FIELD OF THE DISCLOSURE

This disclosure generally relates to exercise machines, and more specifically relates to a machine configured for performing squats and other exercises.

BACKGROUND OF THE DISCLOSURE

A conventional exercise machine used for performing squats helps strengthen muscles using stabilized weight, which is guided through a range of motion by the machine. However, performing the squats creates stress on knees and back, causing improper conditioning of the muscles around targeted areas of a user's body while exercising. Knee pain from using the squat machine is common because the machine forces the user's body into fixed movement patterns and places shearing loads on the user's knees. Further, the conventional machine tends to make the user rest directly against the machine and forces the user into unnatural movement patterns losing balance while pushing a weighted bar upwardly. This creates more back stress, especially with heavier weights, thereby causing lower back pain.

SUMMARY OF THE DISCLOSURE

According to the present disclosure, there is provided an exercise machine for a user performing squats. Included in the exercise machine is a base for supporting the exercise machine. An upright member having a free end and an attachment end is mounted to the base at the attachment end and configured to be straddled by the user. A leg pad assembly is adjustably attached to the upright member for vertically adjusting a height of the leg pad assembly. The leg pad assembly has a first leg pad member extending horizontally relative to the upright member and configured to engage a back of the user's legs. A locking mechanism is provided for selectively releasably securing the leg pad assembly in a desired position on the upright member.

In another embodiment, there is provided an exercise machine for a user performing squats. Included in the exercise machine is a base for supporting the exercise machine. An upright member having a free end and an attachment end is mounted to the base at the attachment end and configured to be straddled by the user. A leg pad assembly is slidably attached to the upright member. The leg pad assembly has a locking mechanism for releasably fixing a position of the leg pad assembly on the upright member. Further, the leg pad assembly has a first leg pad member extending horizontally relative to the upright member and configured to engage a back of the user's legs, and a second leg pad member extending horizontally relative to the upright member, substantially parallel to the first leg pad member and configured to engage a front of the user's legs. A handlebar is adjustably attached to adjacent the free end of the upright member and extends transversely relative to the upright member.

In yet another embodiment, there is provided an exercise machine for a user performing squats. Included in the exercise machine are an angled upright member having a free end and an attachment end, and a base assembly. The attachment end of the upright member is connected to a rear portion of the base assembly, and the base assembly further includes a forward portion configured for receiving the user's feet. A roller assembly is adjustably attached to the upright member for vertically adjusting a height of the roller assembly. The roller assembly has a first pair of roller pads extending horizontally relative to the upright member and configured to engage a back of the user's legs, and a second pair of roller pads extending horizontally relative to the upright member, substantially parallel to the first pair of roller pads and configured to engage a front of the user's legs. One pair of roller pads is horizontally adjustable relative to the other pair of roller pads.

The foregoing and other aspects and features of the disclosure will become apparent to those of reasonable skill in the art from the following detailed description, as considered in conjunction with the accompanying drawings.

DETAILED DESCRIPTION OF THE PREFERRED EMBODIMENTS

Preferred embodiments of the present disclosure are described below by way of example only, with reference to the accompanying drawings.

Figure 1:
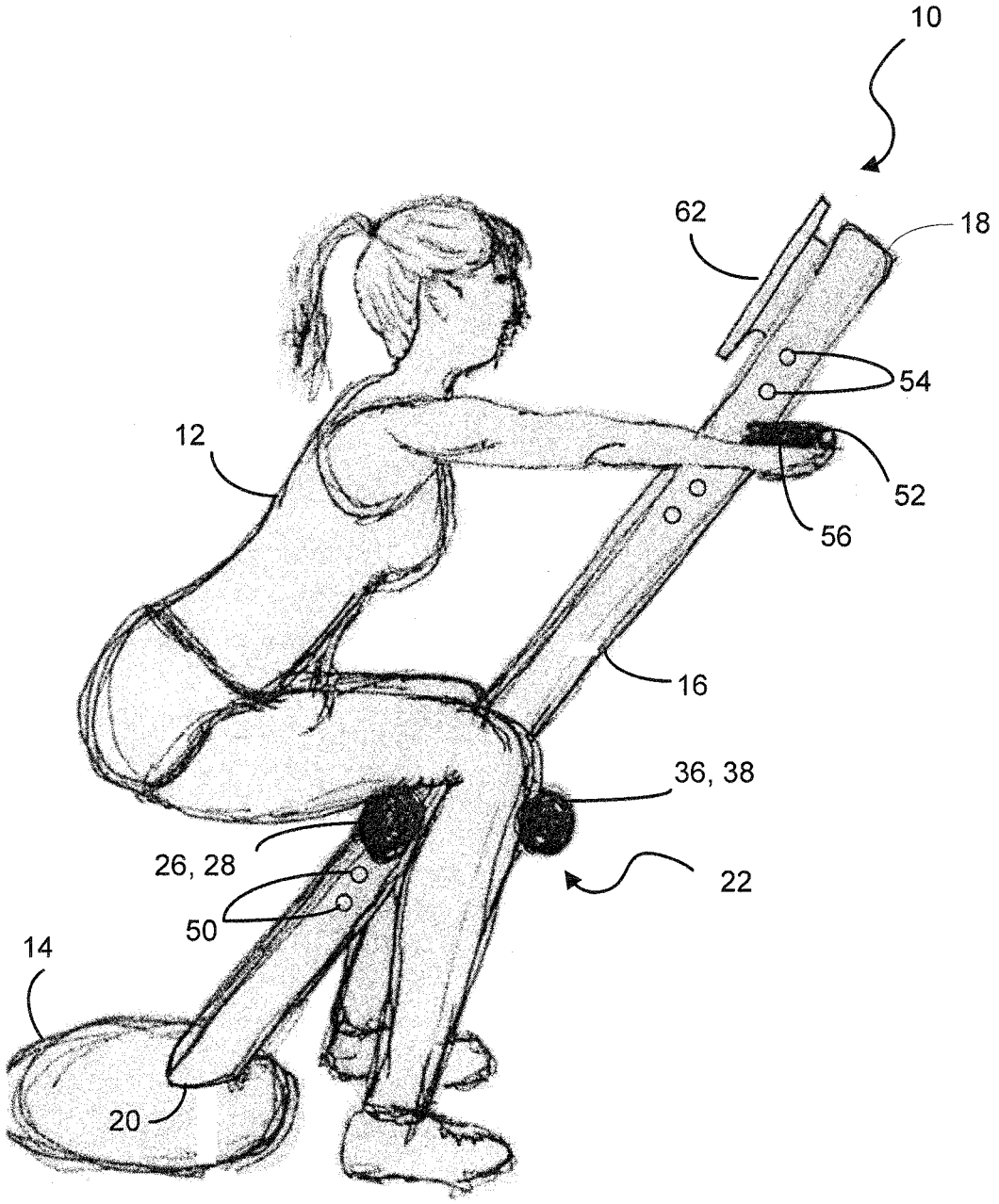
FIG. 1 is a side view of an exemplary squat machine in accordance with an embodiment of the present disclosure.

FIG. 1 shows an exemplary squat machine, generally designated 10, constructed in accordance with the present disclosure. A user or an exerciser 12 performs squats or other suitable exercises on the machine 10, for example, to seek rehabilitation and/or better conditioning of muscles in the user's body. Included in the squat machine 10 is a base 14 for supporting the machine. An upright member 16 having a free end 18 and an attachment end 20 is mounted to the base 14 at the attachment end. While other shapes are contemplated, the upright member 16 has a square tube shape.

Another aspect of the machine 10 is that the upright member 16 is inclined at an angle relative to the base 14 such that the free end 18 of the upright member 16 is positioned away from the user during exercise. This arrangement of the angled upright member 16 allows the user 12 to straddle the machine 10 as if riding the upright member. A leg pad assembly, generally designated 22, is constructed and arranged for being movable along the upright member 16 in upward and downward directions, and thus a height of the leg pad assembly 22 can be vertically adjusted below knee level of the user 12 in a squatted position.

Figure 2:
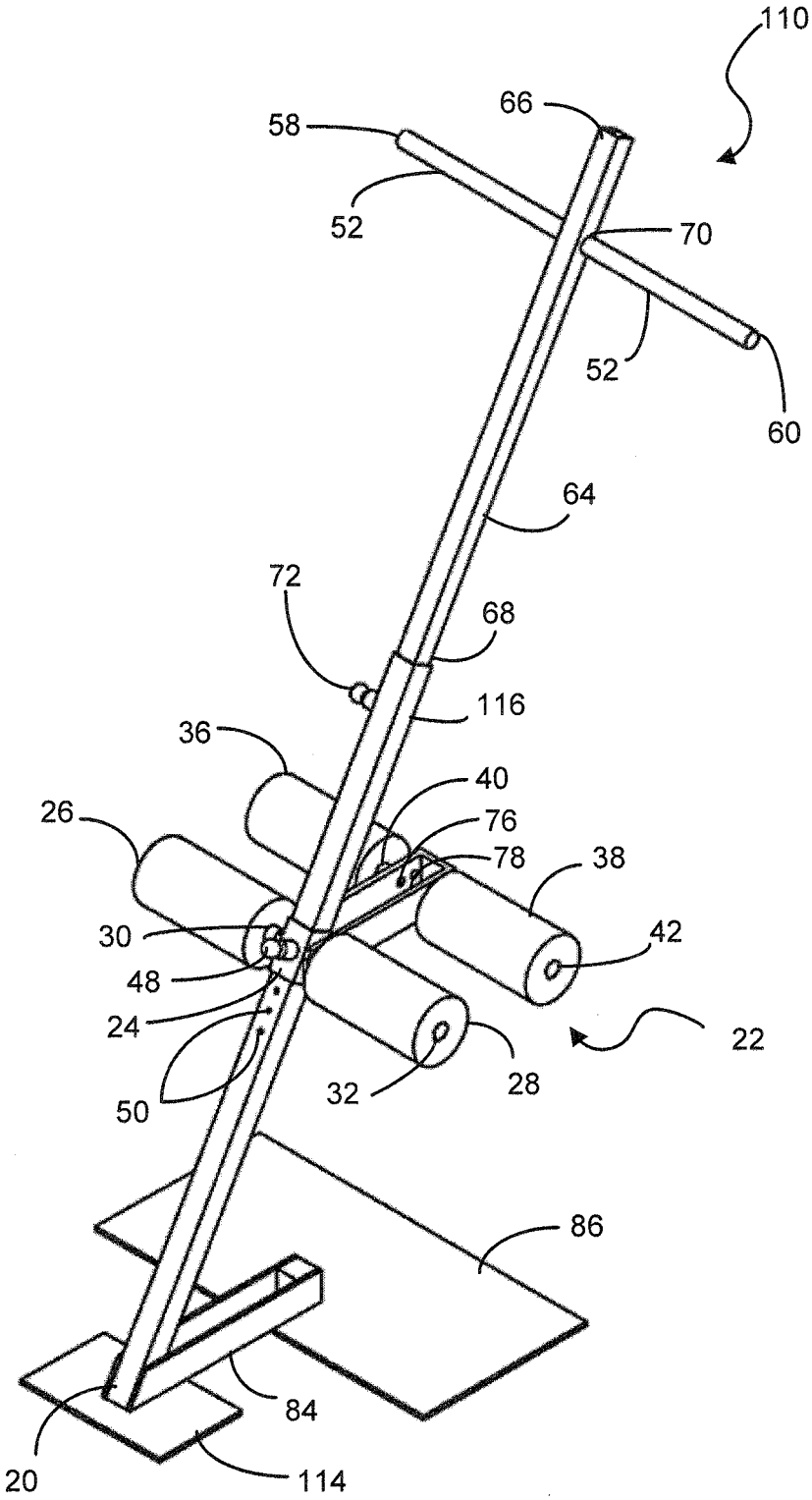
FIG. 2 is a front perspective view of another embodiment of the present squat machine.
Figure 3:
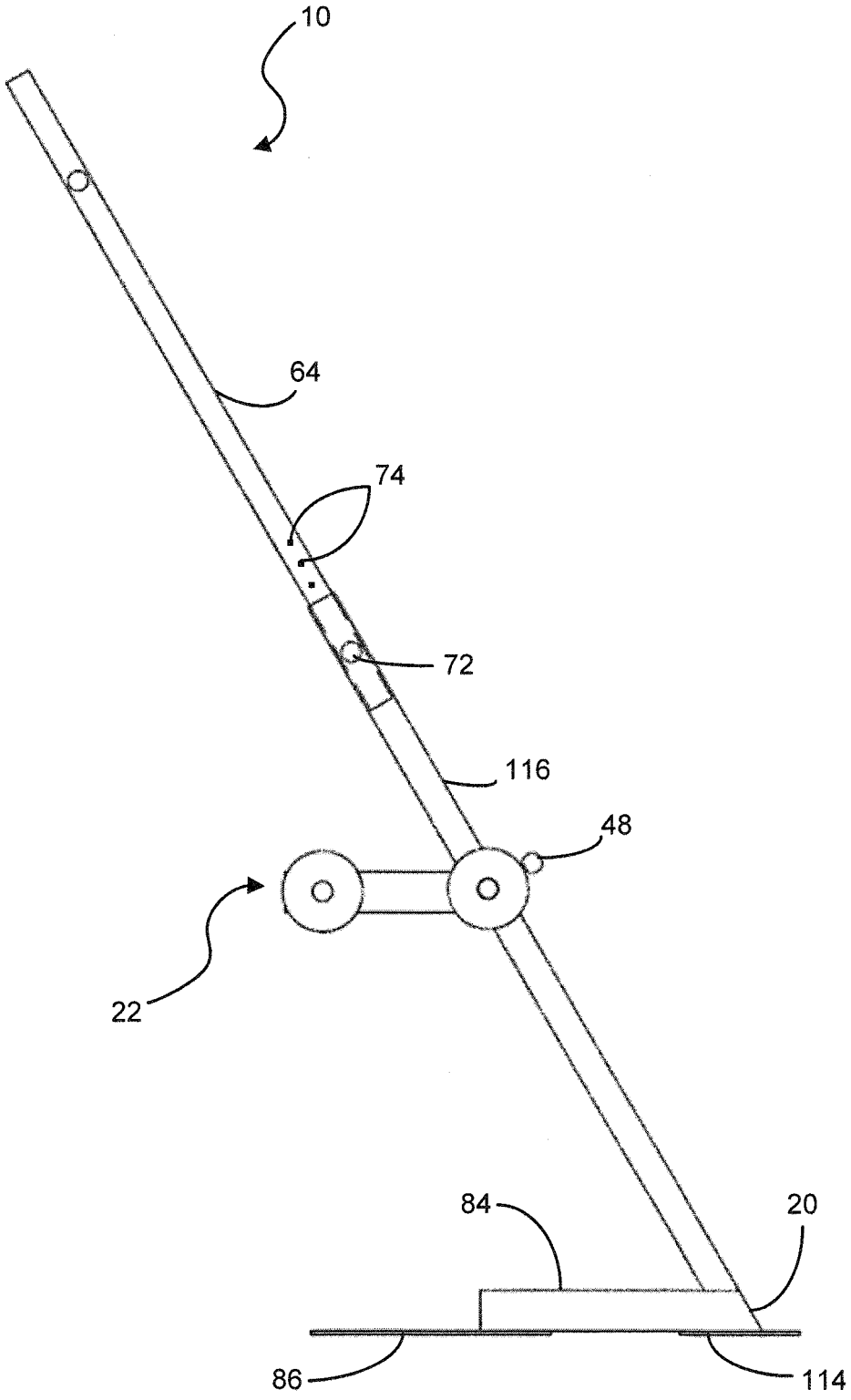
FIG. 3 is a side view of the squat machine shown in FIG. 2.
Figure 4:
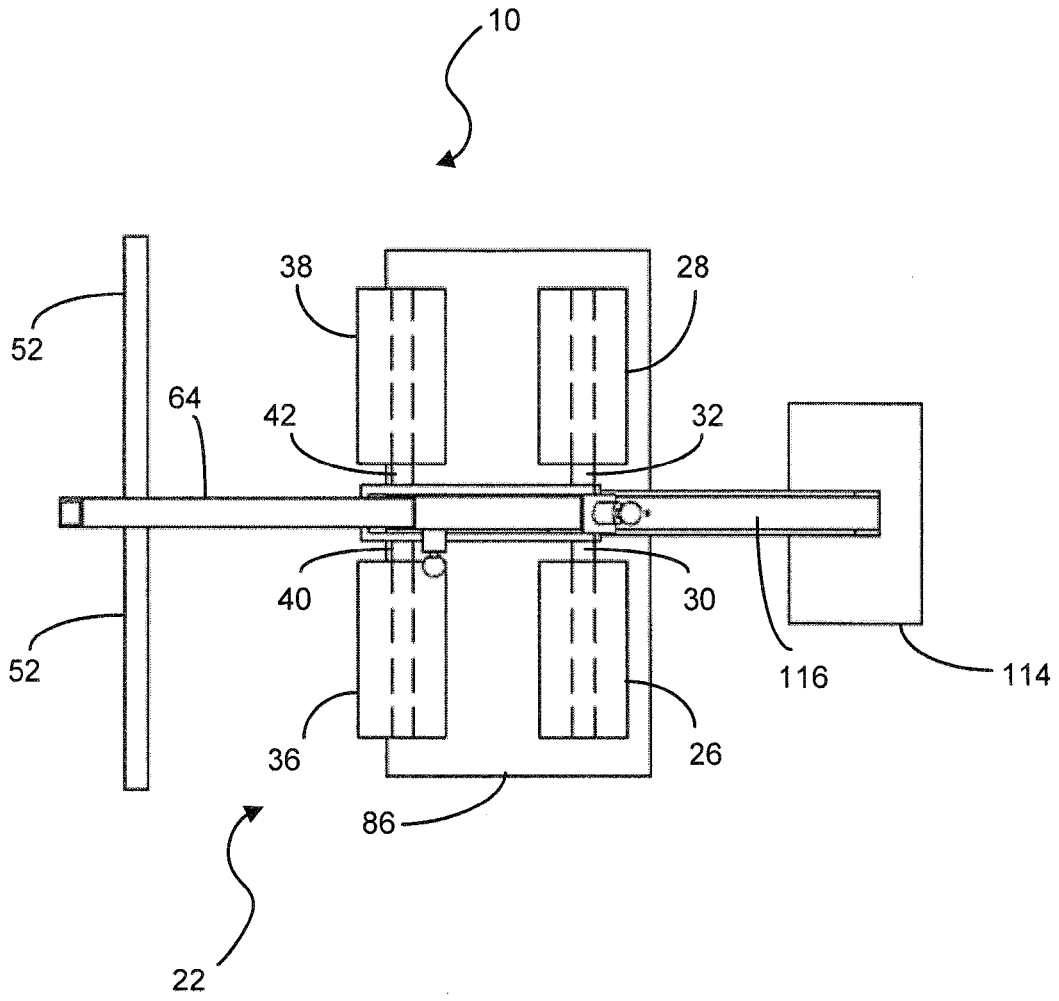
FIG. 4 is a plan view of the squat machine shown in FIG. 2.
Figure 5:
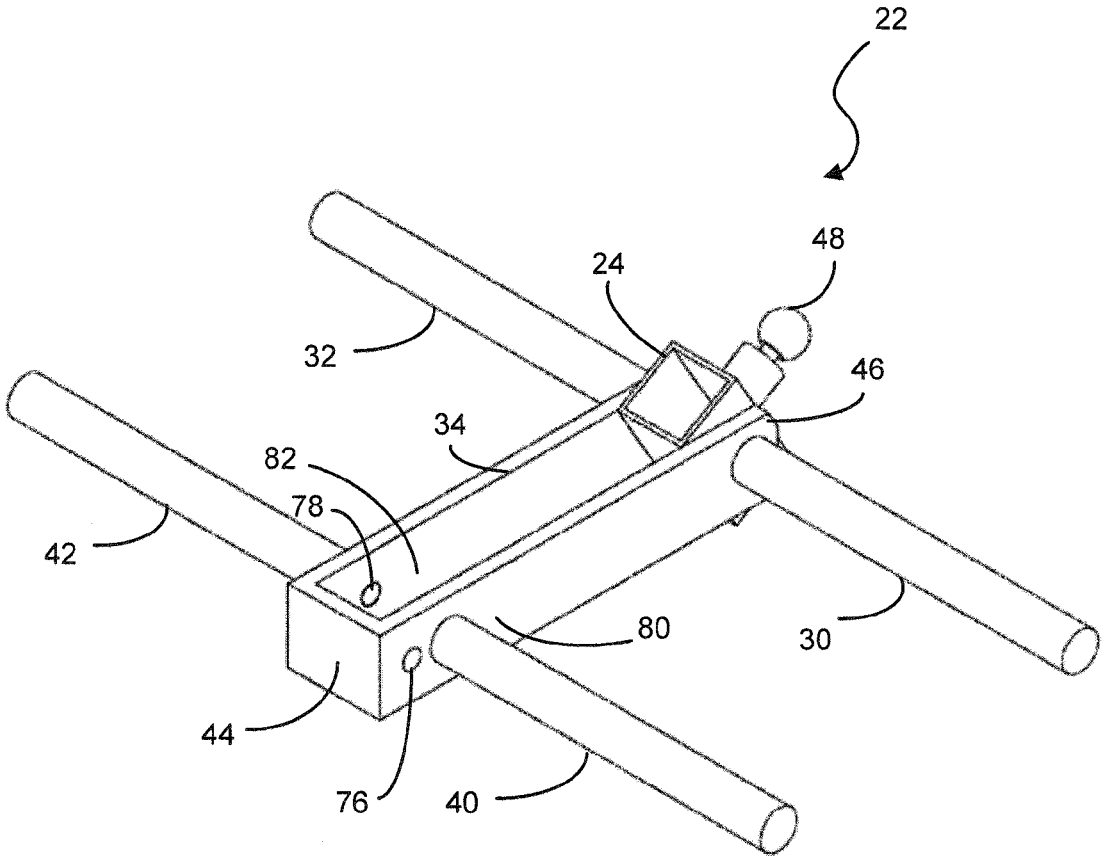
FIG. 5 is an enlarged perspective view of a leg pad assembly of the squat machine.

As best shown in FIGS. 1, 2 and 5, the leg pad assembly 22 includes a pad assembly mount 24 configured for adjustable attachment to the upright member 16. In one embodiment, the pad assembly mount 24 comprises a square tube section sized to fit over and slide on the upright member 16. A first or rear pair of roller pads 26, 28 is mounted on first and second rods 30, 32 that extend horizontally from opposite sides of the pad assembly mount 24. Specifically, independently rotatable first roller pads 26, 28 are installed on the respective first and second rods 30, 32. The rear pair of roller pads 26, 28 is configured to abut and support the rear sides of the user's lower legs below the knees during exercise.

Optionally, the leg pad assembly 22 includes a support arm 34 for supporting a second or front pair of roller pads 36, 38, similar to the pads 26, 28. Roller pads 36, 38 are mounted respectively to third and fourth rods 40, 42. As with the first and second rods 30, 32, the third and fourth rods 40, 42 similarly extend horizontally from opposite sides of a distal end 44 of the support arm 34. More specifically, a proximate end 46 of the support arm 34 is coupled to the pad assembly mount 24, and each roller pad of the second pair 36, 38 is rotatably mounted to the respective third and fourth rods 40, 42. The front pair of roller pads 36, 38 is installed to abut and support the front sides of the user's lower legs and/or knees during exercise.

The height of the leg pad assembly 22 can be adjusted and fixed by a first locking pin 48 mounted on the pad assembly mount 24. For example, a spring-biased locking pin with a handle can be used to selectively and vertically adjust and fix the height of the leg pad assembly 22 relative to the upright member 16. Specifically, the upright member 16 has multiple vertically spaced apertures 50 configured for receiving the first locking pin 48 and securing the leg pad assembly 22. While other locations are envisioned depending on the application, it is preferred that the apertures 50 are located around and below the knee level of the user 12 in the squatted position. Further, as shown in FIGS. 1 and 2, the apertures 50 may be disposed on any of the four sides of the upright member 16, 116. Other types of devices are contemplated for selectively positioning and setting the leg pad assembly 22 at a desired height.

It is preferred that the first locking pin 48 is retracted from one of the apertures 50 by pulling the pin away from the upright member 16 against an action of a spring (not shown) of the first locking pin such that the leg pad assembly 22 slides in upward and downward directions along the upright member. A desired height of the leg pad assembly 22 is selected and secured by releasing and inserting the first locking pin 48 into one of the apertures 50 on the upright member 16 under the action of the spring (not shown). While a spring-loaded locking pin is shown for illustrative purposes, other types of locking mechanisms are also contemplated, such as conventional selector pins, or plunger pins with knobs or handles.

Handlebars 52 are adjustably attached to adjacent the free end 18 of the upright member 16 such that the handlebars are disposed around a shoulder level of the user 12 in the squatted position. During exercise, the user 12 holds onto the handlebar 52 for maintaining balance of the user's body. As with the leg pad assembly 22, the handlebar 52 is also adjustable in height along the upright member 16. In one embodiment, the handle bar 52 is selectively inserted into one of multiple vertically spaced openings 54 located at the free end 18 of the upright member 16. A locking mechanism can be used to secure the handlebars 52 to the upright member 16. Optionally, a pair of handgrips 56 is attached to respective ends 58, 60 of the handlebar 52 for comfort.

It is also contemplated that a monitoring device 62 is optionally attached to near the free end 18 of the upright member 16 for recording and displaying information about user's activities during exercise, such as a number of repetitions and sets the user completed in a predetermined period.

FIGS. 2-5 show another embodiment of the machine 10, generally designated 110. Components shared with the machine 10 are designated with identical reference numbers. Machine 110 includes a two-part upright member 16, namely an upper member 64 and a lower member 116. The upper member 64 has a distal end 66 and a proximate end 68, where the proximate end is inserted into the lower member 116 such that the upper member is slidably adjustable, i.e., telescoping, within the lower portion of upright member 16. In this embodiment, the handlebars 52 are fixedly or rotatably attached to adjacent the distal end 66 of the upper member 64 opposite a base 114 by inserting the handlebars 52 into an opening 70. Other means for attaching the handlebars 52 to the upper member 64 are contemplated. The handlebars 52 extend transversely or horizontally relative to the upright member 16.

More specifically, to provide vertical adjustability of the handlebar 52, the upright member 16 has a second locking pin 72 for selectively vertically adjusting the height of the handlebar 52 attached to the upper member 64 relative to the lower member 116. As illustrated above, the second locking pin 72 operates similarly to the first locking pin 48. For example, the upper member 64 has a plurality of vertically spaced apertures 74 configured for receiving the second locking pin 72 and securing the upper member. As is the case with the apertures 50, while other locations are envisioned depending on the application, it is preferred that the apertures 74 are located around a chest level of the user 12 in the squatted position.

Further, to provide horizontal adjustability of the second pair of roller pads 36, 38, it is also contemplated that multiple internally threaded openings 76, 78 are disposed on opposite sides 80, 82 of the distal end 44 of the support arm 34. Specifically, the threaded openings 76, 78 are provided for selectively receiving and rotatably securing the third and fourth rods 40, 42 in respective threaded openings. For example, the rods 40, 42 have transverse threaded ends (not shown) and the ends are rotatably fastened into the threaded openings 76, 78. Then, corresponding roller pads 36, 38 are mounted to the rods 40, 42 respectively. As a result, a distance between the first pair of roller pads 26, 28 and the second pair of roller pads 36, 38 can be adjusted based on, for example, the size of the user's legs.

A base support bracket 84, the base 114, and a panel 86 are provided and arranged for supporting and stabilizing the exercise machine 110. Connection of the bracket 84 to the upright member 16 is preferably achieved using transverse threaded fasteners, such as bolts. For example, the bracket 84 is attached at one end to the attachment end 20 of the upright member 16 and the base 114. An opposite end of the bracket 84 is attached to the panel 86. Whereas the base 114 and panel 86 are shown as having rectangular shapes for illustrative purposes, different geometries, such as circular, multilateral, and/or dished shapes, are also contemplated.

While preferred embodiments of the disclosure have been herein illustrated and described, it is to be appreciated that certain changes, rearrangements and modifications may be made therein without departing from the scope of the disclosure as defined by the appended claims.

What is claimed is:

1. An exercise machine for a user performing squats, comprising:

a base for supporting the exercise machine;

an upright member having a free end and an attachment end, the upright member being mounted to the base at the attachment end and configured to be straddled by the user; and a leg pad assembly adjustably attached to the upright member, the leg pad assembly having a pad assembly mount fitting and being slidable on the upright member, a first leg pad member extending horizontally relative to the upright member and configured to engage a back of the user's legs, a second leg pad member extending horizontally relative to the upright member and configured to engage a front of the user's legs, and a locking mechanism coupled to the pad assembly mount for selectively releasably securing the leg pad assembly in a desired position on the upright member, wherein, during use, the first leg pad member engages the back of the user's legs, and the second leg pad member engages the front of the user's legs, wherein the user's legs are disposed between the first and second leg pad members at the same vertical position with respect to the ground.

2. The exercise machine of claim 1, wherein the upright member comprises an upper member and a lower member, the upper member being extendable and retractable by telescoping relative to the lower member.

3. The exercise machine of claim 2, wherein the upright member has a locking pin for selectively vertically adjusting a height of the handlebar relative to the upright member.

4. The exercise machine of claim 3, wherein the upper member has a plurality of vertically spaced apertures configured for receiving the locking pin and securing the upper member.

5. The exercise machine of claim 2, wherein a releasably attachable handlebar is transversely attached near a distal end of the upper member opposite the base.

6. The exercise machine of claim 1, further comprising a removable handlebar transversely attached near the free end of the upright member.

7. The exercise machine of claim 6, wherein the handlebar is adjustable in height on the upright member.

8. The exercise machine of claim 6, further comprising a pair of handgrips attached to respective ends of the handlebar.

9. The exercise machine of claim 1, wherein the leg pad assembly includes a support arm having a distal end and a proximate end, and a second leg pad member mounted to the distal end of the support arm, the second leg pad member extending horizontally parallel to the first leg pad member and being configured to engage a front of the user's legs.

10. The exercise machine of claim 9, wherein at least one of the first and second leg pad members are adjustably mounted on the support arm such that a distance between the first and second leg pad members can be adjusted.

11. The exercise machine of claim 1, wherein the locking mechanism includes a locking pin for selectively vertically adjusting the leg pad assembly relative to the upright member.

12. The exercise machine of claim 11, wherein the upright member has a plurality of vertically spaced apertures configured for receiving the locking pin and securing the leg pad assembly on the upright member.

13. The exercise machine of claim 1, wherein the first leg pad member comprises a first pair of roller pads, each roller pad extending horizontally outwardly relative to the upright member, one pad on each side of the upright member.

14. The exercise machine of claim 1, wherein the upright member is inclined at an angle relative to the base such that the free end of the upright member is positioned away from the user during exercise.

15. The exercise machine of claim 1, further comprising a monitoring device being attached near the free end of the upright member for recording and displaying information about the user's activities during exercise.

16. The exercise machine of claim 1, wherein the base comprises a base support member being connected at one end to a base plate and at an opposite end to a panel configured for receiving the user's feet, and wherein the upright member is mounted to the base support member.

17. An exercise machine for a user performing squats, comprising:

a base for supporting the exercise machine;

an upright member having a free end and an attachment end, the upright member being mounted to the base at the attachment end and configured to be straddled by the user;

a leg pad assembly slidably attached to the upright member, the leg pad assembly having a locking mechanism for releasably fixing a position of the leg pad assembly on the upright member, the leg pad assembly having a first leg pad member extending horizontally relative to the upright member and configured to engage a back of the user's legs, and a second leg pad member extending horizontally relative to the upright member, substantially parallel to the first leg pad member and configured to engage a front of the user's legs, wherein the first and second leg pad members are disposed substantially horizontally at a same height relative to the base, such that the first leg pad member engages the back of the user's legs, and the second leg pad member engages the front of the user's legs when in use by the user; and a handlebar adjustably attached to the upright member adjacent to the free end of and extending horizontally relative to the upright member.

18. The exercise machine of claim 17, wherein each of the first and second leg pad members comprises a pair of rotatably mounted roller pads.

19. The exercise machine of claim 17, further comprising a roller support arm being connected at one end to the second leg pad member and at an opposite end to the leg pad assembly, wherein the second leg pad member is horizontally adjustable on the support arm relative to the first leg pad member.

20. An exercise machine for a user performing squats, comprising:

a base for supporting the exercise machine;

an upright member having a free end and an attachment end, the upright member being mounted to the base at the attachment end and configured to be straddled by the user; and a leg pad assembly attached to the upright member, the leg pad assembly having a first leg pad member extending horizontally relative to the upright member and configured to engage a back of the user's legs, and a second leg pad member extending horizontally relative to the upright member and configured to engage a front of the user's legs, wherein the first and second leg pad members are disposed substantially horizontally at a same height relative to the base, such that the first leg pad member engages the back of the user's legs, and the second leg pad member engages the front of the user's legs when in use by the user; and a handlebar attached to the upright member adjacent to the free end of the upright member.

* * * * *